US008784133B2

(12) United States Patent
Suzuki

(10) Patent No.: US 8,784,133 B2
(45) Date of Patent: Jul. 22, 2014

(54) CONNECTOR

(75) Inventor: Masakazu Suzuki, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 27 days.

(21) Appl. No.: 13/816,573

(22) PCT Filed: Apr. 21, 2011

(86) PCT No.: PCT/JP2011/059823

§ 371 (c)(1),
(2), (4) Date: Feb. 12, 2013

(87) PCT Pub. No.: WO2012/029351

PCT Pub. Date: Mar. 8, 2012

(65) Prior Publication Data

US 2013/0143440 A1 Jun. 6, 2013

(30) Foreign Application Priority Data

Sep. 1, 2010 (JP) ..... 2010-195934

(51) Int. Cl.

| | |
|---|---|
| ***H01R 13/40*** | (2006.01) |
| ***H01R 13/422*** | (2006.01) |
| ***H01R 13/516*** | (2006.01) |
| *H01R 13/436* | (2006.01) |

(52) U.S. Cl.

CPC ..... *H01R 13/516* (2013.01); *H01R 13/4364* (2013.01); *H01R 13/4223* (2013.01)

USPC ..... 439/595

(58) Field of Classification Search

USPC ..... 439/595–598, 752, 872

See application file for complete search history.

(56) References Cited

U.S. PATENT DOCUMENTS

| | | | | |
|---|---|---|---|---|
| 7,867,042 | B2 * | 1/2011 | Shuey | 439/752 |
| 7,896,696 | B2 * | 3/2011 | Hamai et al. | 439/595 |
| 8,485,836 | B2 * | 7/2013 | Nakamura | 439/188 |
| 8,602,819 | B2 * | 12/2013 | Uchida | 439/596 |

(Continued)

FOREIGN PATENT DOCUMENTS

| | | |
|---|---|---|
| JP | 4-52384 | 5/1992 |
| JP | 7-65924 | 3/1995 |

(Continued)

OTHER PUBLICATIONS

International Search Report of Jun. 14, 2011.

*Primary Examiner* — Jean F Duverne

(74) *Attorney, Agent, or Firm* — Gerald E. Hespos; Michael J. Porco; Matthew T. Hespos

(57) ABSTRACT

A terminal fitting is inserted into a terminal holding chamber of a front member. A guide recess is in an opposing wall face opposing a lance, of inner faces of a terminal accommodation chamber, an escape recess continuous with the guide recess is in a receiving face of the terminal holding chamber, a guide projection protruding from a position rearward of the front end of an angular tube portion and making sliding contact with a bottom face of the guide recess is in an opposing outer face of the angular tube portion. The length from the guide projection to the front end of the angular tube portion is larger than the distance between the front end of the guide recess and the rear end of the receiving face, and the height of the receiving face relative to the bottom face is smaller than the height of the opposing outer face.

2 Claims, 10 Drawing Sheets

(56) References Cited

U.S. PATENT DOCUMENTS

| | | | | |
|---|---|---|---|---|
| 2009/0186523 | A1* | 7/2009 | Campbell et al. | 439/595 |
| 2010/0136829 | A1* | 6/2010 | Hamai et al. | 439/595 |
| 2011/0165794 | A1* | 7/2011 | Campbell et al. | 439/595 |

FOREIGN PATENT DOCUMENTS

| | | |
|---|---|---|
| JP | 9-171849 | 6/1997 |
| JP | 2001-196122 | 7/2001 |
| JP | 3491751 | 11/2003 |

* cited by examiner

CONNECTOR

CROSS-REFERENCE TO RELATED APPLICATION

This application is based on and claims priority under 35 USC 119 from Japanese Patent Application No. 2010-195934 filed Sep. 1, 2010.

BACKGROUND OF THE INVENTION

1. Field of the Invention

The present invention relates to a connector.

2. Description of the Related Art

Japanese Patent No. 3491751 discloses a connector including a housing in which a terminal accommodation chamber is formed and a front member attached to the housing. In a state in which the front member is attached to the housing, a terminal holding chamber in the recess form in a rear face of the front member is located so as to correspond to an opening at a front end of the terminal accommodation chamber, and a terminal fitting is inserted into a cavity constituted by the terminal accommodation chamber and the terminal holding chamber from behind. In the process of inserting the terminal fitting, a lance formed along an inner wall of the terminal accommodation chamber interferes with the terminal fitting and thus temporarily bends elastically, and when the terminal fitting is properly inserted, the lance that has elastically returned is brought into engagement with the terminal fitting so as to prevent disconnection.

In the above-described connector, as a means for preventing a front end portion of the terminal fitting from interfering with an edge of an opening at a rear end of the terminal holding chamber during insertion of the terminal fitting, a guide slope that is inclined with respect to the insertion direction of the terminal fitting is formed in an inner wall face, of inner wall faces of the terminal holding chamber, that is located on the opposite side from the lance with the terminal fitting sandwiched therebetween.

However, this guide slope merely guides the front end portion of the terminal fitting to the back (front) of the terminal holding chamber, and does not have a function of supporting the front end portion of the terminal fitting that is properly inserted in the terminal holding chamber. This means that as a result of forming the guide slope, the area of a portion of the inner wall faces of the terminal holding chamber that supports the front end portion of the terminal fitting is reduced, and thus there is the problem of a decrease in the reliability of the function of supporting the front end portion of the terminal fitting.

The present invention has been accomplished in view of circumstances as described above, and it is an object thereof to enable the front end portion of the terminal fitting to be inserted into the terminal holding chamber of the front member without hindrance and the inserted front end portion of the terminal fitting to be reliably supported.

SUMMARY OF THE INVENTION

A connector of the present invention includes a housing in which a terminal accommodation chamber is formed and a front member that is configured to be attached to a front end portion of the housing. In a state in which the front member is attached to the housing, a terminal holding chamber in the recess form in a rear face of the front member is located so as to correspond to an opening at a front end of the terminal accommodation chamber, so that a cavity is formed by the terminal accommodation chamber and the terminal holding chamber. In a process of inserting a terminal fitting into the cavity from behind, a lance formed along an inner wall of the terminal accommodation chamber interferes with an angular tube portion of the terminal fitting and thus temporarily bends elastically in a direction intersecting an insertion direction of the terminal fitting. When the terminal fitting is properly inserted and a front end portion of the angular tube portion is accommodated in the terminal holding chamber, the lance that has elastically returned engages with the angular tube portion so as to prevent the angular tube portion from disengaging from the lance. A guide recess extending in the insertion direction of the terminal fitting is formed in an opposing wall face of inner wall faces of the terminal accommodation chamber, the opposing wall face opposing the lance. An escape recess disposed in alignment with the guide recess with a space left therebetween is formed in a receiving face of inner faces of the terminal holding chamber, the receiving face being disposed in alignment with the opposing wall face with a space left therebetween. A guide projection protruding from a position rearward of a front end of the angular tube portion in the insertion direction of the terminal fitting and being capable of making sliding contact with a bottom face of the guide recess is formed in an opposing outer face of outer faces of the angular tube portion, the opposing outer face opposing the opposing wall face and the receiving face. In order for the front end portion of the angular tube portion to oppose the receiving face of the terminal holding chamber before a vertex portion of the guide projection reaches a front end of the guide recess, in the insertion direction of the terminal fitting, a length from the guide projection to the front end of the angular tube portion is set to be larger than a distance between the front end of the guide recess and a rear end of the receiving face, and in an elastic bending direction of the lance, a height of the receiving face relative to the bottom face of the guide recess is set to be smaller than a height of the opposing outer face relative to the bottom face of the guide recess.

In the process of inserting the terminal fitting, the angular tube portion is pushed to the opposing wall face side by the elastic restoring force of the lance, so that the guide projection makes sliding contact with the bottom face of the guide recess, and before the guide projection reaches the front end of the guide recess, the front end portion of the angular tube portion corresponds to the receiving face of the terminal holding chamber. Afterward, when the insertion of the terminal fitting progresses and the guide projection passes the front end of the guide recess, the front end portion of the opposing outer face of the angular tube portion slides on the receiving face, and the terminal fitting reaches the proper insertion position as it is.

Moreover, since the necessity to form a guide slope that is inclined with respect to the insertion direction of the terminal fitting in the receiving face of the front member is eliminated, a long formation region for the receiving face can be ensured in the insertion direction of the terminal fitting, and the front end portion of the angular tube portion can be reliably supported by the front member.

The following configuration may be added to the connector of the present invention.

A displacement restricting portion is formed in at least one of the housing and the front member, the displacement restricting portion being elastically deformed in the state in which the front member is attached to the housing, thereby restricting relative displacement between the housing and the front member in a direction intersecting the insertion direction of the terminal fitting.

This has the following advantages. In a state in which the front member is attached to the housing, if there is play between the housing and the front member in a direction intersecting the insertion direction of the terminal fitting, it is necessary to absorb the play by increasing the protruding length of the guide projection so that a large difference in height between the receiving face and the opposing outer face is ensured in a height direction relative to the bottom face of the guide recess. In this regard, when the displacement restricting portion is elastically deformed in the state in which the front member is attached to the housing, the displacement restricting portion restricts relative displacement between the housing and the front member in a direction intersecting the insertion direction of the terminal fitting, so that the necessity to ensure a large protruding length of the guide projection in order to absorb play is eliminated. Thus, the size of the terminal fitting can be reduced, and therefore the overall size of the connector can be reduced.

DETAILED DESCRIPTION OF THE PREFERRED EMBODIMENTS

Embodiment 1

Hereinafter, Embodiment 1 in which the present invention is embodied will be described with reference to FIGS. 1 to 13. A connector of the present embodiment includes a housing 10, a front member 20 attached to the housing 10 from ahead (the left-hand side in FIGS. 1 to 3), and a plurality of terminal fittings 40 inserted into the housing 10 from behind. It should be noted that in the following description, "direction parallel to the insertion direction of the terminal fittings 40" and "front-rear direction" are used synonymously. Also, the insertion direction of the terminal fittings 40 may be simply referred to as "terminal insertion direction".

Figure 8:
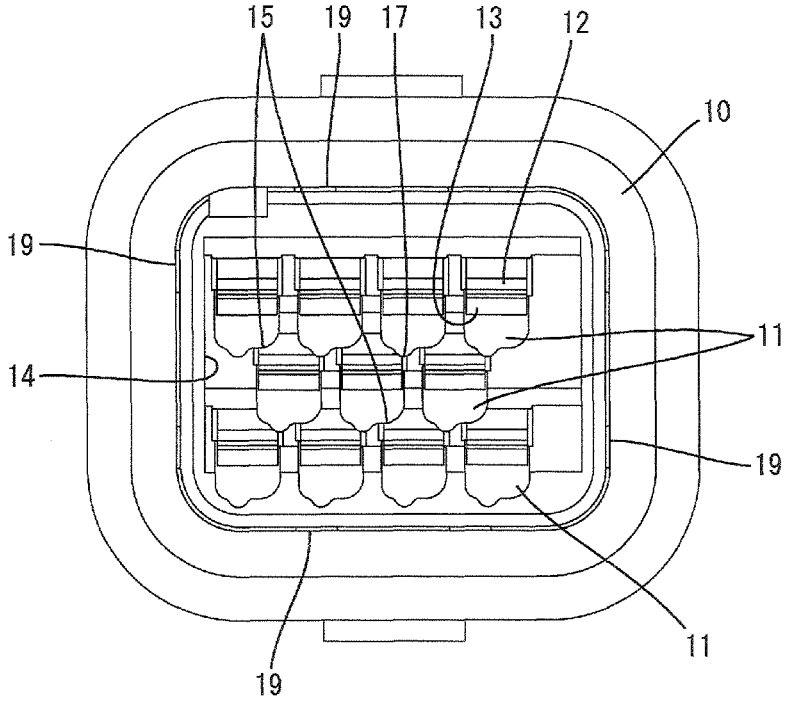
FIG. 8 is a front view of the housing.
Figure 9:
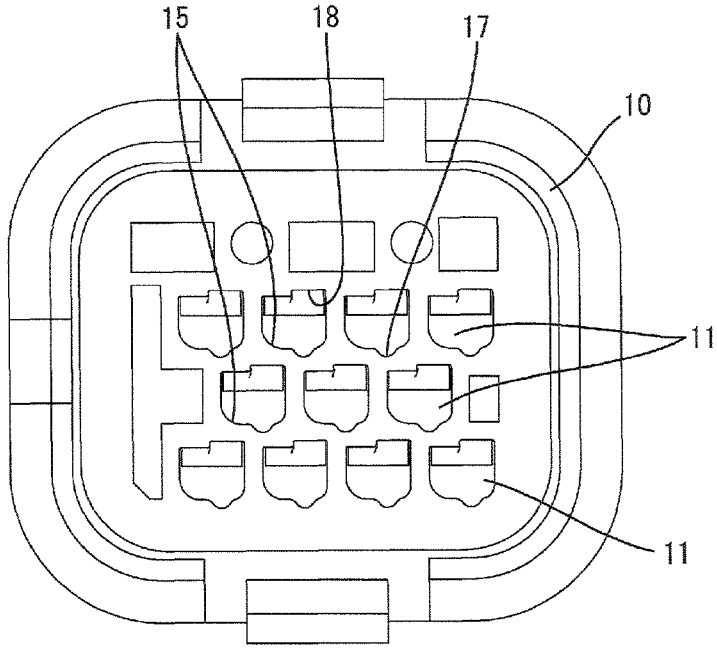
FIG. 9 is a rear view of the housing.
Figure 10:
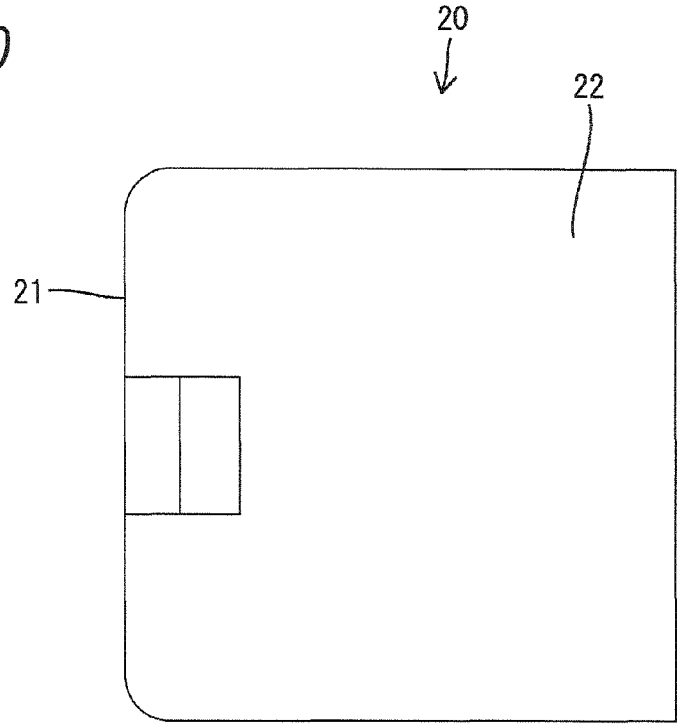
FIG. 10 is a plan view of a front member.
Figure 11:
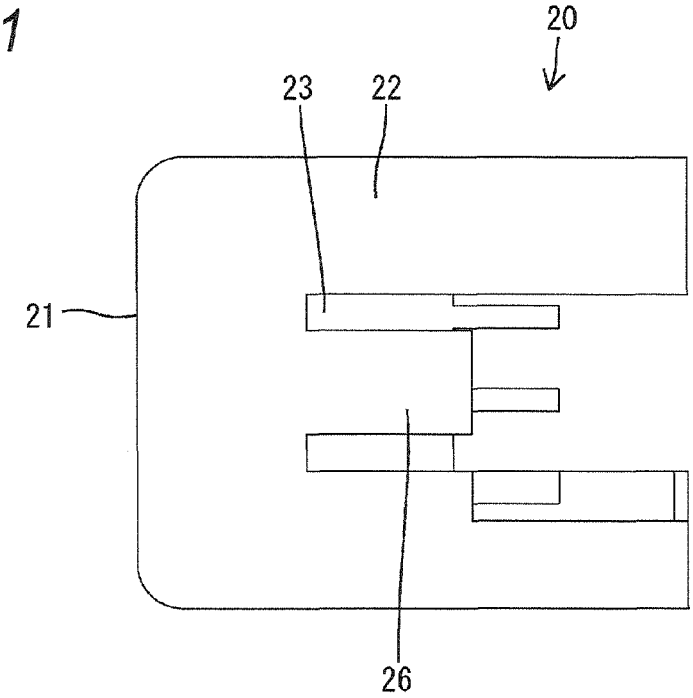
FIG. 11 is a side view of the front member.
Figure 12:
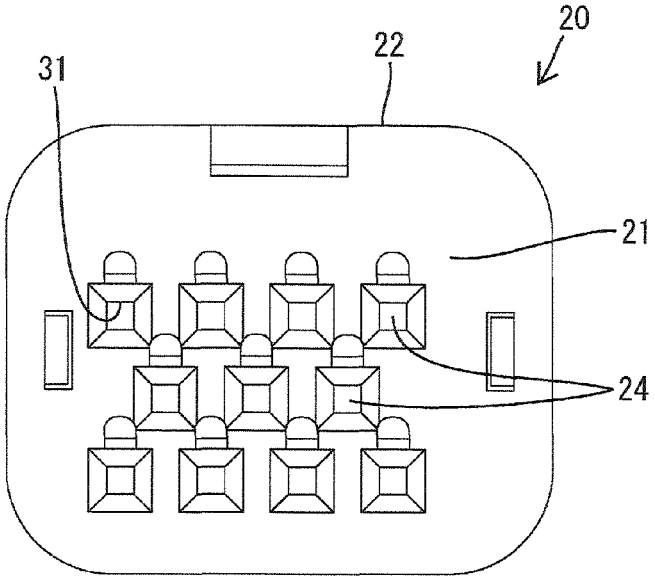
FIG. 12 is a front view of the front member.
Figure 13:
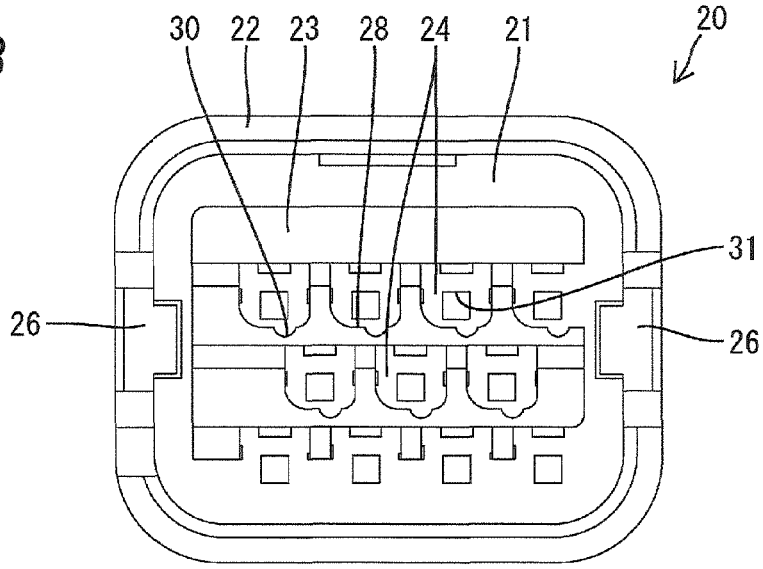
FIG. 13 is a rear view of the front member.

The housing 10 is made of a synthetic resin. A plurality of terminal accommodation chambers 11 penetrating the housing 10 in the front-rear direction are formed in the housing 10. As shown in FIGS. 8 and 9, the plurality of terminal accommodation chambers 11 are divided into three rows in the vertical direction and arranged in these rows so as to be staggered when viewed from ahead and from behind. Among the terminal accommodation chambers 11 in the three rows in the vertical direction, the terminal accommodation chambers 11 in the bottom row are formed so as to be open to a front end face of the housing 10, and these terminal accommodation chambers 11 in the bottom row do not correspond to constituent features of the present invention. On the other hand, front ends of the terminal accommodation chambers 11 in the top row and the terminal accommodation chambers 11 in the middle row are located rearward of the front end face of the housing 10, and the terminal accommodation chambers 11 in the top and middle rows correspond to constituent features of the present invention.

Figure 1:
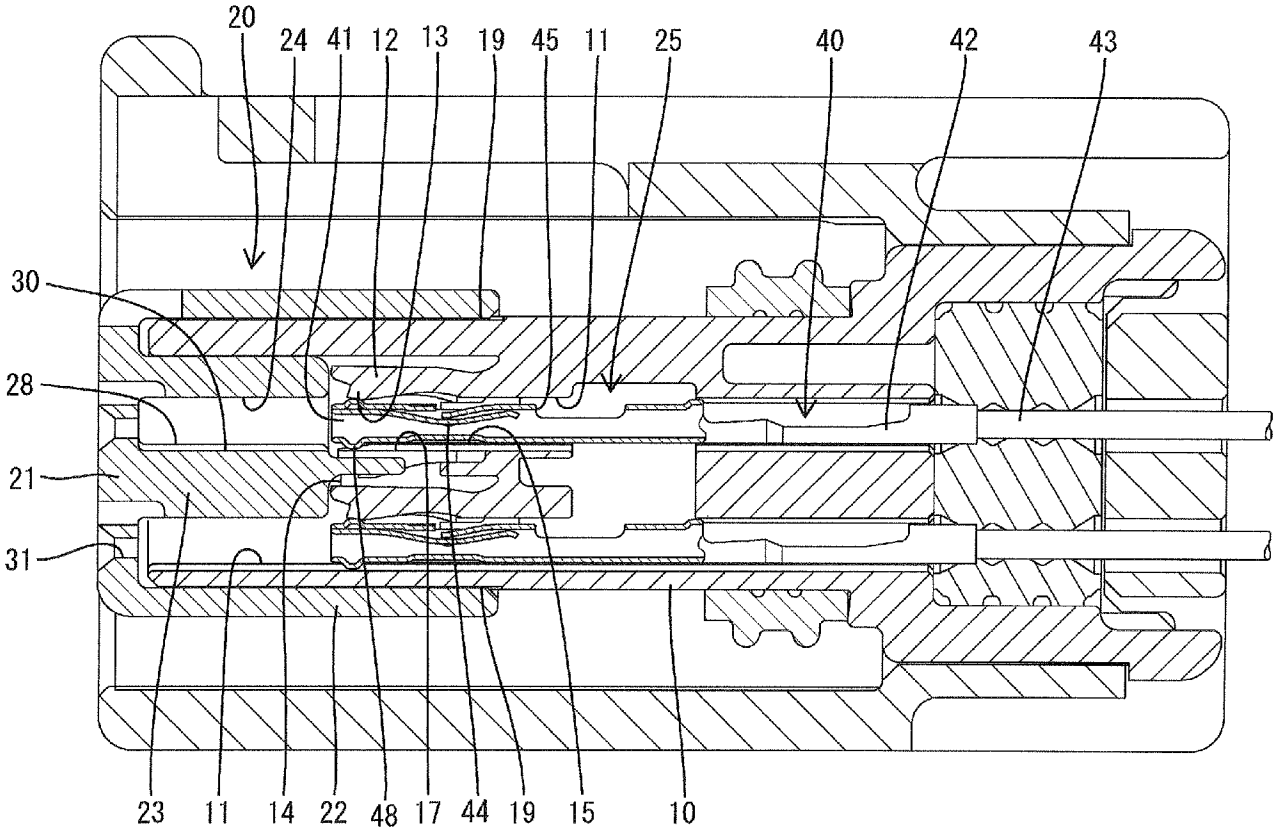
FIG. 1 is a cross-sectional view showing a state in which a terminal fitting has been inserted midway according to Embodiment 1, taken along a line parallel to a terminal insertion direction.
Figure 2:
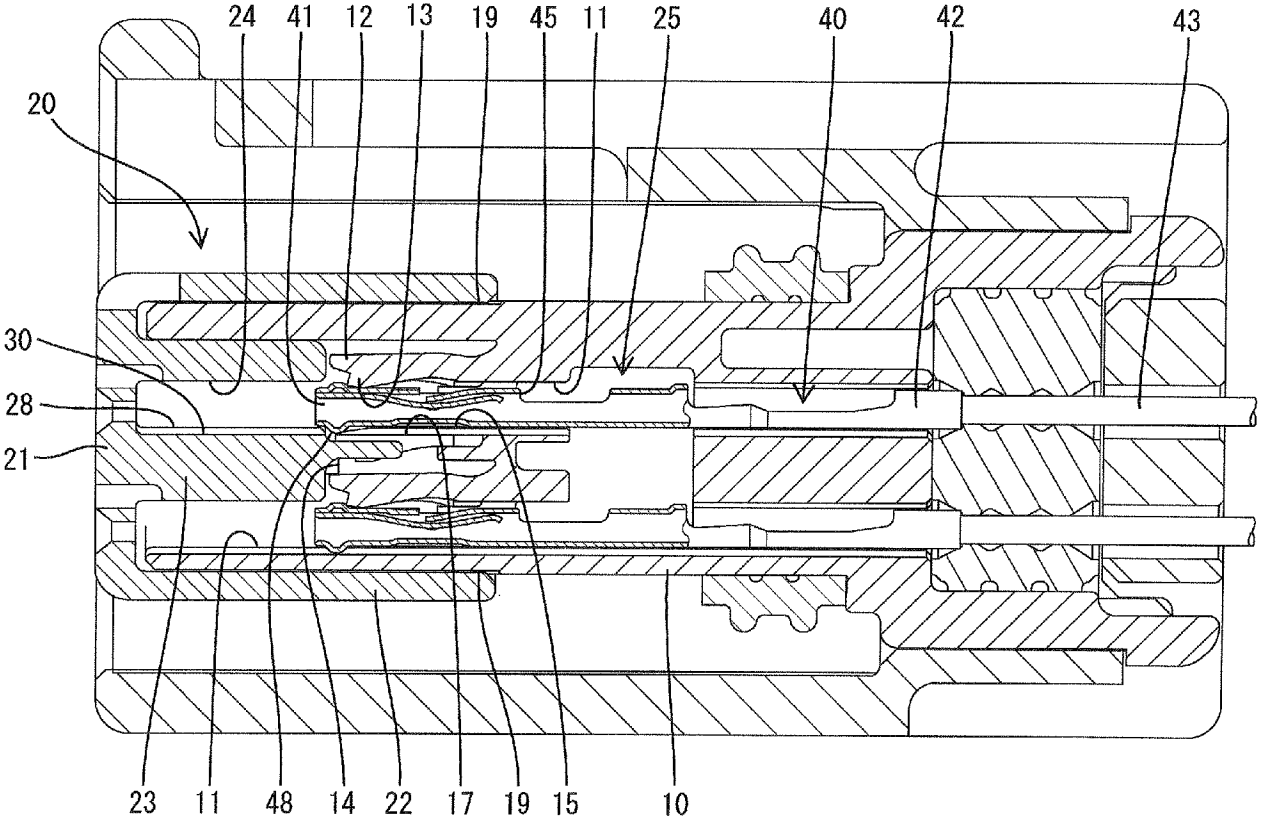
FIG. 2 is a cross-sectional view showing a state in which the terminal fitting has been inserted slightly further than in FIG. 1, taken along a line parallel to the terminal insertion direction.
Figure 3:
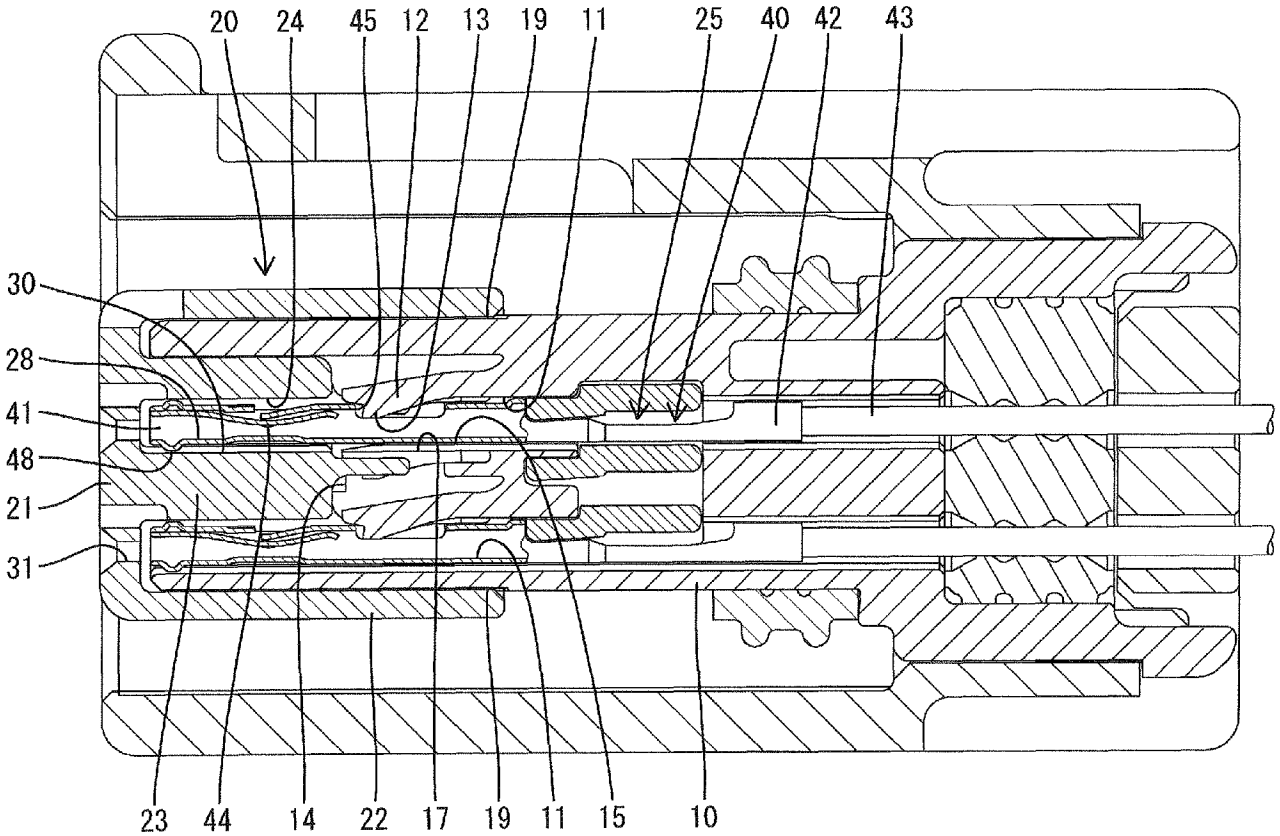
FIG. 3 is a cross-sectional view showing a state in which insertion of the terminal fitting has been completed, taken along a line parallel to the terminal insertion direction.

As shown in FIGS. 1 to 3, a cantilevered lance 12 extending frontward along an upper wall portion of an inner wall portion of each of the terminal accommodation chambers 11 is formed in the housing 10. An engagement projection 13 is formed in a lower face (face facing the terminal accommodation chamber 11) of the lance 12. The lance 12 is usually held in an engaged position shown in FIG. 3 due to the rigidity of the lance 12 itself, and when the lance 12 is located in the engaged position, the engagement projection 13 advances into an insertion path of the terminal fitting 40 in the terminal accommodation chamber 11. Moreover, the lance 12 is configured to be able to elastically bend into a released position shown in FIGS. 1 and 2 when an external force is applied thereto. In a state in which the lance 12 has been displaced into the released position, the engagement projection 13 is retracted upward from the insertion path of the terminal fitting 40 within the terminal accommodation chamber 11. Moreover, the displacement direction of the lance 12 from the engaged position to the released position intersects the insertion direction of the terminal fittings 40 inserted into cavities 25, which will be described later.

As shown in FIGS. 1 to 3 and 8, an accommodation space 14 in the recess form in a front face of the housing 10 is formed in the housing 10. As shown in FIG. 8, the accommodation space 14 has an approximately rectangular shape when viewed from the front, and corresponds to the entire region of the terminal accommodation chambers 11 in the top row, the entire region of the terminal accommodation chambers 11 in the middle row, and an upper half region of the terminal accommodation chambers 11 in the bottom row. Thus, as shown in FIGS. 1 to 3, front end openings of the terminal accommodation chambers 11 in the top row and front end openings of the terminal accommodation chambers 11 in the middle row are located rearward of a front end of the housing 10 and face the inside of the accommodation space 14. Moreover, the engagement projections 13 of the lances 12 formed in the terminal accommodation chambers 11 in the top and middle rows are arranged in approximately the same positions as front end portions of the terminal accommodation chambers 11 in the front-rear direction (the direction parallel to the terminal insertion direction).

Figure 4:
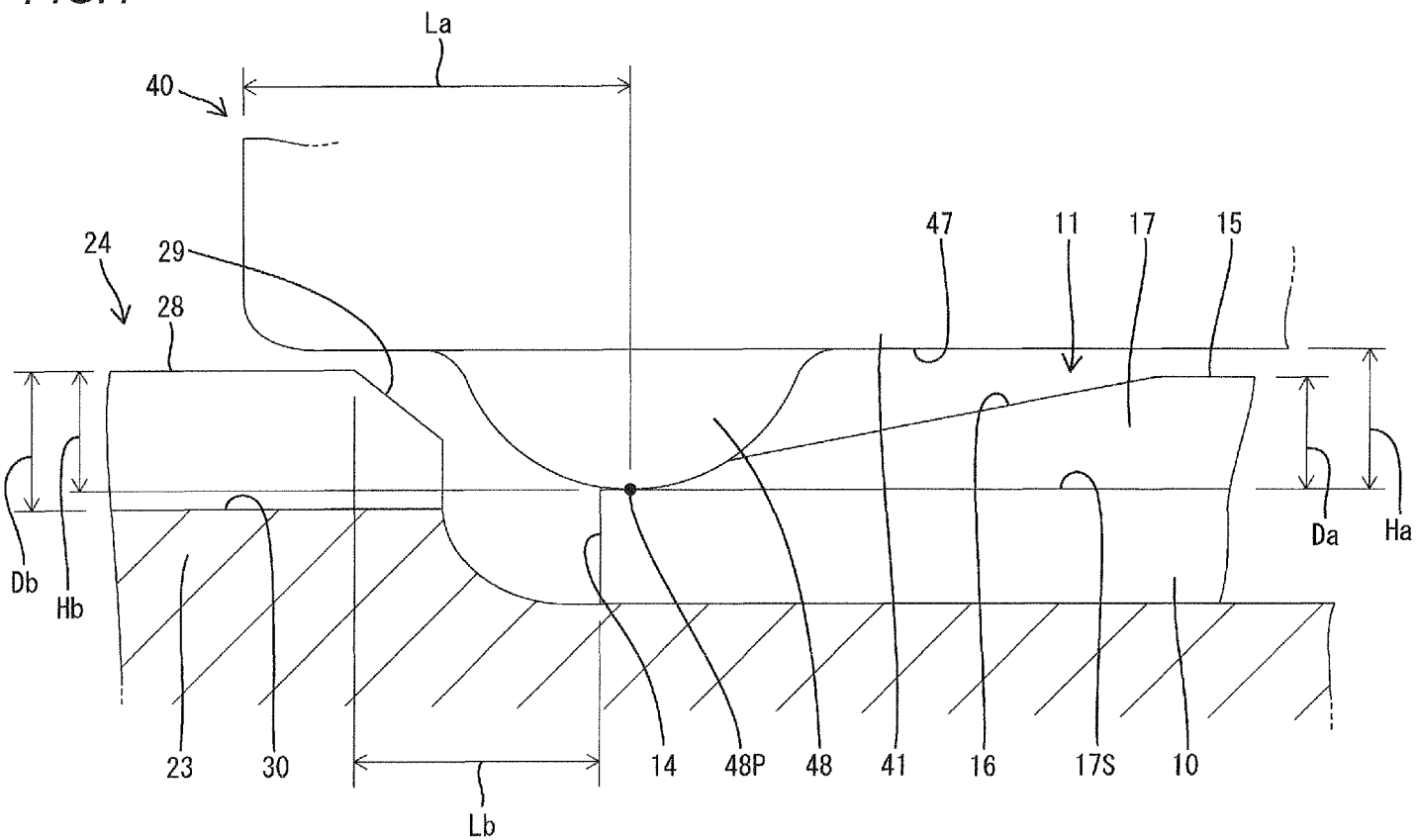
FIG. 4 is a partial enlarged view of FIG. 2.

The terminal accommodation chambers 11 in the top and middle rows (hereinafter simply referred to as the terminal accommodation chambers 11) will be described below. It should be noted that in the cross-sectional views shown in FIGS. 1 to 3, only a terminal accommodation chamber 11 in the top row of the top and middle rows is shown. In the vertical direction (i.e., the direction approximately parallel to the elastic bending direction of the lance 12) intersecting the insertion direction of the terminal fitting 40, a bottom wall face of the inner wall faces of the terminal accommodation chamber 11 constitutes an opposing wall face 15 located on the opposite side from the lance 12 with the terminal fitting 40 sandwiched therebetween. As shown in FIG. 4, a tapered face 16 that is inclined to slope downward toward the front side is formed in a front end portion of the opposing wall face 15. A front end of the tapered face 16 faces the accommodation space 14.

Figure 5:
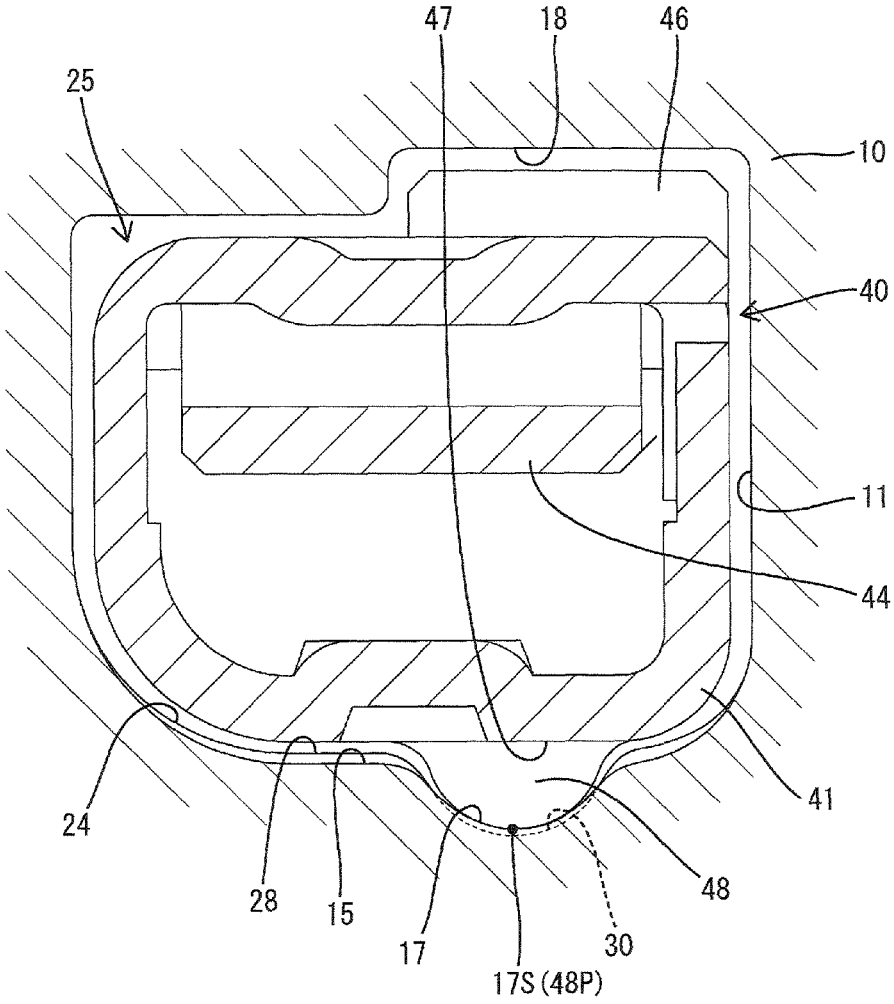
FIG. 5 is a partial enlarged cross-sectional view showing a state in which the terminal fitting has been inserted midway, taken along a line perpendicular to the terminal insertion direction.
Figure 6:
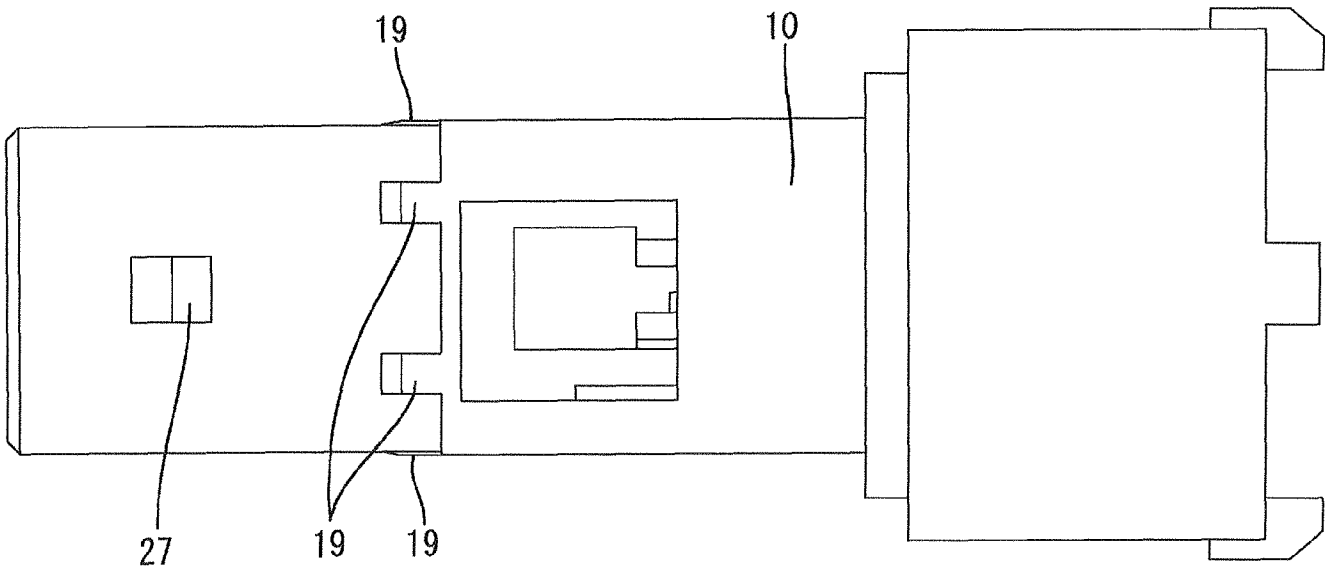
FIG. 6 is a side view of a housing.
Figure 7:
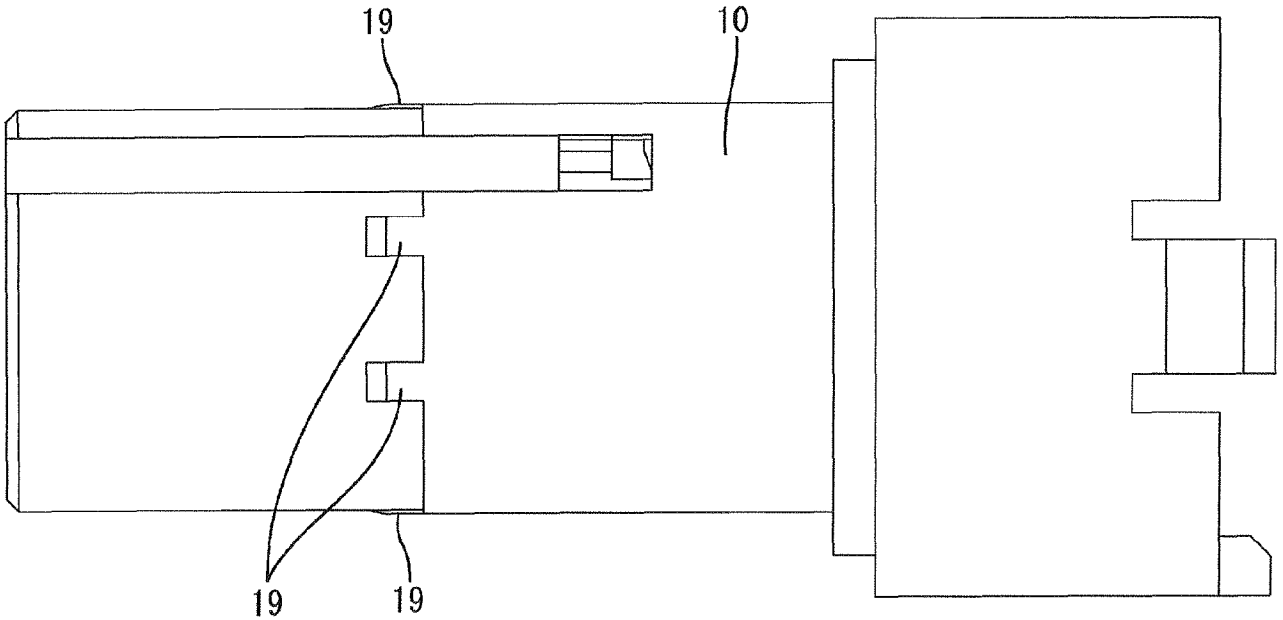
FIG. 7 is a plan view of the housing.

As shown in FIGS. 1 to 5, a guide recess 17 parallel to the insertion direction of the terminal fitting 40 is formed in the opposing wall face 15. As shown in FIGS. 1 to 3, the guide recess 17 is formed along the entire length of the terminal accommodation chamber 11. As shown in FIGS. 5, 8, and 9, the shape of the guide recess 17 when viewed from the front (the shape of a cross-section cut at right angles to the terminal insertion direction) is approximately semicircular. In a width direction (left-and-right direction) intersecting the terminal insertion direction, the position in which the guide recess 17 is formed is laterally shifted (offset) from the center of the terminal accommodation chamber 11. The shifting direction of the guide recess 17 in the width direction is the same as a shifting direction of a misinsertion restricting groove 18 (see FIGS. 5 and 9) formed in an upper wall face (wall face on the opposite side from the opposing wall face 15) of the terminal accommodation chamber 11.

Moreover, as shown in FIGS. 1 to 3 and 6 to 8, a plurality of displacement restricting portions 19 are formed in the housing 10 as protrusions protruding from outer perimeter faces (i.e., upper and lower faces and right and left side faces) of the housing 10. Front end portions of the displacement restricting portions 19 constitute inclined portions. The displacement restricting portions 19 are configured to plastically deform in a state in which the front member 20 is attached to the housing 10.

The front member 20 is made of a synthetic resin and, as shown in FIGS. 1 to 3 and 10 to 13, integrally formed from a front wall 21, a cantilevered tubular fitting portion 22 extending rearward from the entire outer perimeter of the front wall 21, and a terminal holding portion 23 protruding rearward from the front wall 21 and surrounded by the tubular fitting portion 22. A plurality of terminal holding chambers 24 respectively corresponding to the terminal accommodation chambers 11 in the top row and the terminal accommodation chambers 11 in the middle row are formed in the terminal holding portion 23 as separate recesses in a rear face (face opposing a back end face of the accommodation space 14 in an attached state in which the front member 20 is attached to the housing 10) of the terminal holding portion 23. It should be noted that a space corresponding to the terminal accommodation chambers 11 in the bottom row is ensured below the terminal holding portion 23.

As shown in FIGS. 1 to 3, the front member 20 is attached to the housing 10 from ahead. During the attachment, the tubular fitting portion 22 surrounds the entire perimeter of the front end portion of the housing 10, and the terminal holding portion 23 is fitted into the accommodation space 14. Then, in a state in which the front member 20 is properly attached to the housing 10, the front end face of the housing 10 opposes the front wall 21 of the front member 20 while abutting against or being in close proximity to that wall, and a rear end face of the terminal holding portion 23 opposes the back end face of the accommodation space 14 while being in close proximity to that face. In addition, the terminal holding chambers 24 are located so as to be in close proximity to the front side of the corresponding terminal accommodation chambers 11. In other words, the openings at the rear ends of the terminal holding chambers 24 oppose (are in communication with) the openings at the front ends of the corresponding terminal accommodation chambers 11 while being in close proximity to those openings. In addition, the cavities 25 into which the terminal fittings 40 are inserted are formed by the terminal accommodation chambers 11 and the terminal holding chambers 24 aligned in front of the corresponding terminal accommodation chambers 11 with a slight gap left therebetween.

The front member 20 attached to the housing 10 is held in the attached state by engaging locking arms 26 (see FIGS. 11 and 13) formed in side wall portions of the tubular fitting portion 22 with locking holes 27 (see FIG. 6) in outer side faces of the housing 10. Moreover, the plurality of displacement restricting portions 19 formed in the outer perimeter of the housing 10 plastically deform in a state in which those portions are in close contact with an inner perimeter of the tubular fitting portion 22. Due to a frictional force resulting from the plastic deformation of the displacement restricting portions 19, the front member 20 is held in a state in which relative displacement in the vertical direction and the left-and-right direction (i.e., the directions intersecting the terminal insertion direction) and relative displacement in the front-rear direction (i.e., the direction parallel to the terminal insertion direction) with respect to the housing 10 are restricted.

As shown in FIGS. 1 to 4, a region of a bottom face of each terminal holding chamber 24 (i.e., a face, of inner faces of the terminal holding chamber 24, that is located in alignment with the opposing wall face 15 of the terminal accommodation chamber 11 with a space left therebetween) excluding a rear end portion of this bottom face constitutes a receiving face 28. In addition, a region of the bottom face of the terminal accommodation chamber 11 that extends from a rear end of the receiving face 28 to the rear end face of the terminal holding portion 23 constitutes a guiding slope 29 that is inclined so as to slope downward toward the rear side with respect to the insertion direction of the terminal fitting 40. That is to say, the guiding slope 29 is continuous with the rear (the side closer to the terminal accommodation chamber 11) of the receiving face 28.

As shown in FIGS. 1 to 5, an escape recess 30 extending in the terminal insertion direction is formed in the receiving face 28. The escape recess 30 is disposed in a position that is shifted (offset) from a middle position of the terminal accommodation chamber 11 in the width direction to the same side as the guide recess 17. That is to say, the escape recess 30 is disposed in alignment with the guide recess 17 with a space left therebetween. Moreover, as shown in FIG. 5, the shape of the escape recess 30 when viewed from the rear (the shape of a cross section cut at right angles to the terminal insertion direction) is approximately semicircular as is the case with the guide recess 17. Furthermore, tab insertion openings 31 are formed in the front wall 21, which penetrate the front wall 21 in the front-rear direction so as to correspond to the respective terminal accommodation chambers 11.

Each terminal fitting 40 is shaped so as to be elongated as a whole in the front-rear direction as shown in FIGS. 1 to 3 by, for example, bending a metal plate material stamped into a predetermined shape. The terminal fitting 40 is a female terminal, in a front end portion of which an angular tube portion 41 is formed and in a rear end portion of which an electric wire crimping portion 42 is formed. An end portion of an electric wire 43 is fixed to the electric wire crimping portion 42 so that electrical conduction can be established. An elastic contact strip 44 is accommodated in the angular tube portion 41, which has a known form folded back at and extending rearward from a front end of an upper plate portion constituting the angular tube portion 41, and a tab (omitted from the drawings) of a mating terminal inserted from ahead through the tab insertion opening 31 into the angular tube portion 41 is sandwiched between the elastic contact strip 44 and a bottom plate portion (plate portion that is disposed in a position vertically opposite from the upper plate portion) of the angular tube portion 41 and, in this state, brought into elastic contact with the elastic contact strip 44 so that electrical conduction can be established therebetween. Moreover, an engagement hole 45 with which the engagement projection 13 of the lance 12 is engaged is formed in the upper plate portion by cutting out a region slightly rearward of the middle of the angular tube portion 41 in the front-rear direction.

As shown in FIG. 5, a stabilizer 46 is formed in the upper plate portion of the angular tube portion 41 as a protrusion protruding upward (outer side of the angular tube portion 41) from a front end portion of the upper plate portion. The stabilizer 46 is disposed in a position that is offset from the middle of the angular tube portion 41 in the width direction to the same side as a guide projection 48. When the terminal fitting 40 is inserted into the cavity 25, the stabilizer 46 moves in the misinsertion restricting groove 18 of the terminal accommodation chamber 11 and the terminal holding chamber 24. Moreover, if it is attempted to insert the terminal fitting 40 in an improper orientation in which it is vertically inverted or an improper orientation in which it is laterally tilted at 90° into the cavity 25, the stabilizer 46 and the guide projection 48 interfere with an edge of an opening at the rear end of the terminal accommodation chamber 11, thereby restricting the insertion of the terminal fitting 40 in an improper orientation.

As shown in FIGS. 4 and 5, a lower face (outer face) of the bottom plate portion of the angular tube portion 41 constitutes an opposing outer face 47 opposing the opposing wall face 15 of the terminal accommodation chamber 11 and the receiving face 28 of the terminal holding chamber 24. As shown in FIGS. 1 to 5, the guide projection 48 is formed in a front end portion of the opposing outer face 47 by hammering out a portion of the bottom plate portion downward (outer side of the angular tube portion 41) so that the portion protrudes into an approximately semispherical shape. When viewed from a lateral direction that is approximately orthogonal to both of the terminal insertion direction and the protruding direction of the guide projection 48, the guide projection 48 has an approximately semicircular shape (arcuate shape). The guide projection 48 is disposed in a position that is offset laterally (to the same side as the guide recess 17 and the escape recess 30) from the middle of the angular tube portion 41 in the width direction. In the front-rear direction, the entire guide projection 48 is disposed rearward of the front end of the angular tube portion 41.

As shown in an enlarged manner in FIGS. 4 and 5, in the process of inserting the terminal fitting 40 into the cavity 25, a sliding contact point 48P at a protruding end (lower end where the protruding length from the opposing outer face 47 of the terminal fitting 40 is at its maximum) of the guide projection 48 slides on a linear sliding contact portion 17S located at the lowest portion of the bottom face of the guide recess 17 and extending in the front-rear direction. Then, as shown in FIG. 4, in the vertical direction (i.e., the direction generally parallel to the elastic bending direction of the lance 12) intersecting the terminal insertion direction, the protruding length (minimum length within the range of dimensional tolerance) Ha of the sliding contact point 48P of the guide projection 48 from the opposing outer face 47 is set to be larger than the depth Da (maximum depth within the range of dimensional tolerance) of the guide recess 17. In a state in which the guide projection 48 abuts against the bottom face of the guide recess 17, the protruding length Ha of the guide projection 48 is equal to the height of the opposing outer face 47 (the lower face of the angular tube portion 41) relative to the linear sliding contact portion 17S of the guide recess 17. Moreover, the depth Da of the guide recess 17 is equal to the height of the opposing wall portion 15 relative to the linear sliding contact portion 17S.

Similarly, in the vertical direction, the height Hb (height within the range of tolerance) of the receiving face 28 relative to the linear sliding contact portion 17S is smaller than the height Ha (the protruding length of the guide projection 48) of the opposing outer face 47 relative to the linear sliding contact portion 17S and is equal to or greater than the height Da (the depth of the guide recess 17) of the opposing wall face 15 relative to the linear sliding contact portion 17S. Moreover, the depth Db (minimum depth within the range of dimensional tolerance) of the escape recess 30 is equal to or greater than the protruding length Ha (maximum length within the range of dimensional tolerance) of the guide projection 48. Furthermore, in the front-rear direction parallel to the terminal insertion direction, the length La (minimum length within the range of dimensional tolerance) from the sliding contact point 48P (contacting portion that comes into contact with the bottom face of the guide recess 17) of the guide projection 48 to the front end of the angular tube portion 41 is larger than the distance Lb (maximum distance within the range of dimensional tolerance) between the front end (the back end face of the accommodation space 14) of the guide recess 17 and the rear end of the receiving face 28. Furthermore, there is a gap in the front-rear direction between the front end of the terminal accommodation chamber 11 (the front end of the guide recess 17) and the rear end of the terminal accommodation chamber 11 (the rear end of the guiding slope 29).

Next, effects of the present embodiment will be described. A process of inserting the terminal fitting 40 in a state in which the front member 20 is attached to the housing 10 will be described. In the process of inserting the terminal fitting 40 into the cavity 25 from behind, the stabilizer 46 moves in the misinsertion restricting groove 18, and the guide projection 48 moves in the guide recess 17. Then, after a front end edge of the upper plate portion of the angular tube portion 41 abuts against the engagement projection 13 of the lance 12, and as the terminal fitting 40 is further inserted, the lance 12 is elastically bent from the engaged position to the released position higher than the engaged position. Consequently, the angular tube portion 41 is pushed downward by the elastic restoring force of the lance 12, so that the sliding contact point 48P of the guide projection 48 slides on the linear sliding contact portion 17S of the guide recess 17. At this time, the lower face (the opposing outer face 47) of the angular tube portion 41 is kept in a noncontact state in which it is separated upward from the opposing wall face 15 of the terminal accommodation chamber 11.

When insertion of the terminal fitting 40 progresses in this manner and, as shown in FIG. 1, the guide projection 48 reaches a location close to the front end of the guide recess 17, the front end of the angular tube portion 41 passes through the front end of the terminal accommodation chamber 11, protrudes into the accommodation space 14, and approaches the rear end of the terminal accommodation chamber 11. Even in this state, the lance 12 is still elastically bent, and therefore the angular tube portion 41 is pushed downward (to the opposing wall face 15 side). Subsequently, immediately after the state in FIG. 1, as shown in FIGS. 2 and 4, while the sliding contact point 48P of the guide projection 48 is sill abutting against the bottom face (the linear sliding contact portion 17S) of the guide recess 17, the front end portion of the angular tube portion 41 enters the terminal accommodation chamber 11, resulting in a state in which the opposing outer face 47 (lower face) of the front end portion of the angular tube portion 41 is in close proximity to and opposes the rear end portion of the receiving face 28 of the terminal accommodation chamber 11 from above. At this time, since the height Hb of the receiving face 28 relative to the linear sliding contact portion 17S is smaller than the height Ha of the opposing outer face 47 relative to the linear sliding contact portion 17S, the front end of the angular tube portion 41 does not interfere with the rear end face and the guiding slope 29 of the terminal holding portion 23. Moreover, the lance 12 is still elastically bent.

Subsequently, immediately after the state shown in FIGS. 2 and 4, the guide projection 48 leaves the front end of the guide recess 17, and accordingly, the elastic restoring force of the lance 12 slightly displaces the angular tube portion 41 downward, so that the opposing outer face 47 abuts against (rests on) the receiving face 28. After that, while the opposing outer face 47 slides on the receiving face 28, the front end portion of the angular tube portion 41 enters the terminal accommodation chamber 11. In this course, the guide projection 48 enters the escape recess 30, but since the depth Db of the escape recess 30 is equal to or greater than the protruding length Ha of the guide projection 48, the state in which the opposing outer face 47 is in sliding contact with the receiving face 28, that is, the state in which the angular tube portion 41 is supported by the receiving face 28 from below is maintained.

Subsequently, when the terminal fitting 40 reaches the proper insertion position, as shown in FIG. 3, the engagement hole 45 advances to the position corresponding to the engagement projection 13, so that the lance 12 elastically returns from the released position to the engaged position, the engagement projection 13 engages with the engagement hole 45 from behind, and thus, the terminal fitting 40 is held in a disconnection preventing state in which disconnection thereof is prevented.

As described above, in the connector of the present embodiment, the guide recess 17 extending in the terminal insertion direction is formed in the opposing wall face 15, which opposes the lance 12, of the inner wall faces of the terminal accommodation chamber 11, the escape recess 30 disposed in alignment with the guide recess 17 with a space left therebetween is formed in the receiving face 28, which is disposed in alignment with the opposing wall face 15 with a space left therebetween, of the inner faces of the terminal holding chamber 24, and the guide projection 48, which protrudes from a position rearward of the front end of the angular tube portion 41 in the terminal insertion direction and which is capable of making sliding contact with the bottom face of the guide recess 17, is formed in the opposing outer face 47, which opposes the opposing wall face 15 and the receiving face 28, of the outer faces of the angular tube portion 41. Moreover, in the terminal insertion direction, the length La from the sliding contact point 48P of the guide projection 48 making sliding contact with the guide recess 17 to the front end of the angular tube portion 41 is set to be larger than the distance Lb between the front end of the guide recess 17 and the rear end of the receiving face 28, and in the elastic bending direction of the lance 12, the height of the receiving face 28 relative to the linear sliding contact portion 17S (sliding contact region that is brought into sliding contact with the guide projection 48) of the bottom face of the guide recess 17 is set to be smaller than the height Ha of the opposing outer face 47 relative to the linear sliding contact portion 17S.

With this configuration, in the process of inserting the terminal fitting 40, the elastic restoring force of the lance 12 pushes the angular tube portion 41 to the opposing wall face 15 side, so that the guide projection 48 makes sliding contact with the bottom face of the guide recess 17, and before the guide projection 48 reaches the front end of the guide recess 17, the front end portion of the angular tube portion 41 corresponds to the receiving face 28 of the terminal holding chamber 24. Afterward, when the insertion of the terminal fitting 40 progresses and the guide projection 48 passes the front end of the guide recess 17, the front end portion of the opposing outer face 47 of the angular tube portion 41 slides on the receiving face 28, and the terminal fitting 40 reaches the proper insertion position as it is.

Therefore, according to the present embodiment, the necessity to form, in the receiving face 28 of the front member 20, a guide slope inclined with respect to the insertion direction of the terminal fitting 40 and extending along a long distance is eliminated, so that a long formation region for the receiving face 28 can be ensured in the insertion direction of the terminal fitting 40, and the front end portion of the angular tube portion 41 can be reliably supported by the front member 20. That is to say, with the connector of the present embodiment, it is possible to insert the angular tube portions 41 of the terminal fittings 40 into the terminal holding chambers 24 of the front member 20 without hindrance and to reliably support the inserted angular tube portions 41.

Moreover, in the state in which the front member 20 is attached to the housing 10, if there is play between the housing 10 and the front member 20 in the vertical or the left-and-right direction intersecting the insertion direction of the terminal fitting 40, it is necessary to absorb the play by increasing the protruding length of the guide projection 48 and ensuring a large difference in height between the receiving face 28 and the opposing outer face 47 in the height direction relative to the bottom face of the guide recess 17.

In contrast, according to the present embodiment, in the state in which the front member 20 is attached to the housing 10, the displacement restricting portions 19 are elastically deformed, thereby restricting relative displacement between the housing 10 and the front member 20 in directions intersecting the insertion direction of the terminal fitting 40, and therefore, it is not necessary to ensure a large protruding length of the guide projection 48 in order to absorb play. Thus, it is possible to reduce the size of the terminal fittings 40 and therefore reduce the overall size of the connector.

Other Embodiments

It should be appreciated that the present invention is not limited to the embodiment described above and shown in the drawings, and, for example, the following embodiments are also included within the technical scope of the present invention.

(1) In the above embodiment, a case where the terminal fittings are female terminals in the front end portions of which the angular tube portions are disposed has been described; however, the present invention is also applicable to cases where the terminal fittings are male terminals in which elongated tabs protrude from the front ends of the angular tube portions.

(2) In the above embodiment, a configuration in which a guiding slope that is inclined with respect to the insertion direction of the terminal fitting is formed to the rear of and continuous with the receiving face has been described; however, a configuration in which no guiding slope is provided to the rear of the receiving face also may be employed.

(3) In the above embodiment, a configuration in which a tapered face that is inclined with respect to the insertion direction of the terminal fitting is formed in the front end portion of the opposing wall face has been described; however, a configuration in which no tapered face is formed in the front end portion of the opposing wall face also may be employed.

(4) In the above embodiment, a configuration in which the guide projection is disposed in a position that is laterally separated from the middle position of the terminal fitting in the width direction has been described; however, the guide projection also may be disposed in the middle position of the terminal fitting in the width direction.

(5) In the above embodiment, a configuration in which the shape of the guide projection is approximately semicircular (arcuate) when viewed in the lateral direction approximately orthogonal to both of the insertion direction of the terminal fitting and the protruding direction of the guide projection has been described; however, the shape of the guide projection when viewed in the lateral direction also may be a shape without a circular arc portion, such as a trapezoid or a triangle, or may be a combined shape of a straight line portion and a circular arc portion.

(6) In the above embodiment, a configuration in which the guide projection doubles as an inverted insertion preventing means for preventing insertion of a terminal fitting in an inverted, improper orientation has been described; however, the guide projection also may be a dedicated guide means for reliably moving the terminal fitting to the receiving face of the front member.

(7) In the above embodiment, a configuration in which the guide projection is formed by hammering out a portion of the plate-like portion (the bottom plate portion) constituting the angular tube portion so that that portion protrudes to the outer face side has been described; however, the guide projection also may be formed by being cut and raised.

(8) In the above embodiment, a configuration in which in the insertion direction of the terminal fitting, a part (the engagement projection) of the lance that is brought into sliding contact with the terminal fitting during the process of insertion is disposed in the position corresponding to the front end portion of the opposing wall portion (the terminal accommodation chamber) has been described; however, the sliding contact part (the engagement projection) of the lance that is brought into sliding contact with the terminal fitting also may be disposed in a position that is largely shifted rearward from the front end of the opposing wall portion (the terminal accommodation chamber).

(9) In the above embodiment, a configuration in which in the state in which the front member is attached to the housing, a gap is created in the front-rear direction (the direction parallel to the insertion direction of the terminal fittings) between the front member and the housing in the vicinity of the opposing wall face and the receiving face has been described; however, a configuration in which such a gap is not created also may be employed.

(10) In the above embodiment, a configuration in which the displacement restricting portions are formed in only the housing has been described; however, a displacement restricting portion also may be formed in only the front member or may be formed in both of the housing and the front member.

The invention claimed is:

1. A connector comprising:

a housing in which a terminal accommodation chamber is formed; and a front member that is configured to be attached to a front end portion of the housing, wherein, in a state in which the front member is attached to the housing, a terminal holding chamber in a recess form in a rear face of the front member is located so as to correspond to an opening at a front end of the terminal accommodation chamber, so that a cavity is formed by the terminal accommodation chamber and the terminal holding chamber, in a process of inserting a terminal fitting into the cavity from behind, a lance formed along an inner wall of the terminal accommodation chamber interferes with an angular tube portion of the terminal fitting and thus temporarily bends elastically in a direction intersecting an insertion direction of the terminal fitting, when the terminal fitting is properly inserted and a front end portion of the angular tube portion is accommodated in the terminal holding chamber, the lance that has elastically returned engages with the angular tube portion so as to prevent the angular tube portion from disengaging from the lance, a guide recess extending in the insertion direction of the terminal fitting is formed in an opposing wall face of inner wall faces of the terminal accommodation chamber, the opposing wall face opposing the lance, an escape recess disposed in alignment with the guide recess with a space left therebetween is formed in a receiving face of inner faces of the terminal holding chamber, the receiving face being disposed in alignment with the opposing wall face with a space left therebetween, a guide projection protruding from a position rearward of a front end of the angular tube portion in the insertion direction of the terminal fitting and being capable of making sliding contact with a bottom face of the guide recess is formed in an opposing outer face of outer faces of the angular tube portion, the opposing outer face opposing the opposing wall face and the receiving face, in order for the front end portion of the angular tube portion to oppose the receiving face of the terminal holding chamber before a vertex portion of the guide projection reaches a front end of the guide recess, in the insertion direction of the terminal fitting, a length from the guide projection to the front end of the angular tube portion is set to be larger than a distance between the front end of the guide recess and a rear end of the receiving face, and in an elastic bending direction of the lance, a height of the receiving face relative to the bottom face of the guide recess is set to be smaller than a height of the opposing outer face relative to the bottom face of the guide recess.

2. The connector according to claim 1, wherein a displacement restricting portion is formed in at least one of the housing and the front member, the displacement restricting portion being elastically deformed in the state in which the front member is attached to the housing, thereby restricting relative displacement between the housing and the front member in the direction intersecting the insertion direction of the terminal fitting.

* * * * *